United States Patent [19]

Tsuji et al.

[11] 4,377,333

[45] Mar. 22, 1983

[54] RECORDING APPARATUS

[75] Inventors: Takao Tsuji; Junji Ichikawa, both of Kawasaki; Hiroo Ichihashi, Tokyo; Yoshinori Sugiura, Kawasaki; Takashi Nakano; Kazuhiro Hirayama, both of Yokohama, all of Japan

[73] Assignee: Canon Kabushiki Kaisha, Tokyo, Japan

[21] Appl. No.: 184,563

[22] Filed: Sep. 5, 1980

Related U.S. Application Data

[63] Continuation of Ser. No. 931,928, Aug. 8, 1978, abandoned.

[30] Foreign Application Priority Data

| | | | |
|---|---|---|---|
| Aug. 12, 1977 | [JP] | Japan | 52-96716 |
| Sep. 5, 1977 | [JP] | Japan | 52-106481 |
| Sep. 5, 1977 | [JP] | Japan | 52-106482 |
| Sep. 8, 1977 | [JP] | Japan | 52-108211 |
| Sep. 14, 1977 | [JP] | Japan | 52-108567 |
| Sep. 14, 1977 | [JP] | Japan | 52-110941 |

[51] Int. Cl.[3] ..... G03G 15/00

[52] U.S. Cl. ..... 355/3 SH; 355/3 TR; 355/16

[58] Field of Search ..... 355/3 SH, 3 R, 3 TE, 355/3 TR, 14 R, 16

[56] References Cited

U.S. PATENT DOCUMENTS

| | | | |
|---|---|---|---|
| 3,068,356 | 12/1962 | Codichini | 250/326 |
| 3,358,081 | 12/1967 | Young et al. | 346/160 |
| 3,907,421 | 9/1975 | Jordon et al. | 355/3 TR |
| 3,998,538 | 12/1976 | Urso et al. | 355/14 X |
| 4,045,135 | 8/1977 | Doi et al. | 355/3 TE |
| 4,110,025 | 8/1978 | Tabata | 355/3 TR |
| 4,110,027 | 8/1978 | Sato et al. | 355/3 TR |

*Primary Examiner*—Richard L. Moses

*Attorney, Agent, or Firm*—Fitzpatrick, Cella, Harper & Scinto

[57] ABSTRACT

There is provided a recording apparatus including a holder member upon which an image is formed by scanning a modulated beam, a transfer device for transferring the formed image to a continuous transfer material, a transfer material transporting device for loading the continuous transfer paper and a feeding device for feeding the transfer material. The transfer material transporting device includes a set of members which open to accommodate the transfer material, a holder for retaining the transfer material, an endless rotary member which moves the holder through the open members and a control for controlling the opening and closing of the members. The feeding device includes an index and a transporting mechanism for moving the continuous transfer material a distance corresponding to the distance between the index and transfer device. The feeding device also includes another transport mechanism, both transport mechanisms beginning and stopping at different times. The recording apparatus is also provided with a potential measuring head located along the scanning path but not beyond the print end region on the holder member.

13 Claims, 29 Drawing Figures

FIG.6A 1934
2324
0147
4218

189
473

FIG.6B

| NAME | VOTES |
|---|---|
| TANAKA | |
| MASAKI | |
| ITOH | |
| SATOH | |
| | |
| | |

| NAME | VOTES | |
|---|---|---|
| TANAKA | 1934 | |
| MASAKI | 2324 | |
| ITOH | 0147 | |
| SATOH | 4218 | |
| | | |
| | | 189 |
| | | 473 |

RECORDING APPARATUS

This is a continuation, of application Ser. No. 931,928, filed Aug. 8, 1978, now abandoned.

BACKGROUND OF THE INVENTION

1. Field of the Invention

The present invention relates to a recording apparatus adapted for high-speed print-out of characters, graphic information, etc. supplied particularly from computers. The word 'recording apparatus' herein used should be understood in the widest sense and includes printing and copying apparatus.

2. Description of the Prior Art

Although mechanical impact printers have been most widely utilized as the output device for computers, the recent advancement in the electronic technologies and the resulting increase in the processing capacity of calculating devices and memories require the development of output printers with a performance superior to that of conventional mechanical impact printers. Though there have been developed various non-impact printers to respond to this requirement, particularly advantageous, in consideration of speed, print quality and running cost, is the so-called transfer type electrostatic or electrophotographic recording process in which, as disclosed for example in the U.S. Pat. No. 3,358,081, an electrostatic latent image corresponding to the information from a computer etc. is formed on an image carrying member such as a photosensitive member and developed into a visible image with a toner material, said visible image being transferred onto a plain paper sheet (recording material) and fixed thereon to obtain a final output consisting of toner image fixed on a plain paper.

In such an electrophotographic recording process, and as a means for fixing toner onto a recording paper (including various forms of paper such as fan-fold form and continuous roll form) there is usually employed a mechanism consisting of a heated fixing roller and a back-up roller maintained in pressure contact, through said paper, with said fixing roller. In such mechanism threading of paper between said rollers is difficult to achieve in a manual operation since the fixing roller is maintained at a high temperature (for example ca. 180° C.).

Also a transfer charger is generally provided in the transfer position of toner image onto paper, and it is quite cumbersome, in case of perform recording from perforations on the paper, namely from the leading end of a page, to maintain said perforations in register with said transfer position.

Furthermore there exists a similar concern in case of restarting the advancement of paper after a temporary stop, for example for achieving an exact synchronization with other processing means.

Furthermore, in such a process, the position of information recording on a photosensitive member to form an electrostatic latent image thereon is generally different from the position of image transfer from said photosensitive member onto a sheet, and, also along the path of said recording sheet, said transfer and said fixing are generally conducted in different positions.

Thus, even if the recording process is interruped upon detection of the trailing end of a recording sheet, the transfer step has to be continued thereafter since there still exists, on the photosensitive member, an electrostatic latent image and a toner image which is not yet transferred.

In order to complete the transfer of said electrostatic latent image and the untransferred toner image, there is naturally required a margin on the recording sheet of a length equal to the distance between the recording position and the transfer position both on said photosensitive member. Stated differently the detector for the trailing end of the transfer sheet is required to be provided in a position far enough from said transfer position to assure said margin on the transfer sheet.

Such requirement, resulting from the above-mentioned distance between the transfer and fixing positions and also from the distance between said transfer position and the conveyor means for the transfer sheet, has been accommodated, conventionally, by placing the unprinted transfer sheet in a position distanced by a necessary length from said conveyor means, sacrificing the compactness of the apparatus.

SUMMARY OF THE INVENTION

The object of the present invention is to provide a recording apparatus adapted for high-speed print-out of characters, graphic information etc. supplied particularly from computers.

Another object of the present invention is to provide a recording apparatus adapted for forming an electrostatic latent image corresponding to characters or graphic information supplied from computers etc. on a carrying member, rendering said latent image visible by means of colored particles (toner) and transferring the thus obtained visible image onto a continuous transfer material followed by fixing thereby obtaining a hard copy of a high image quality at a high speed.

Still another object of the present invention is to provide a recording apparatus provided with an automatic loading mechanism in the advancing path of the transfer sheet material for automatic threading thereof into a fixing station functioning at a high temperature.

Still another object of the present invention is to provide a recording apparatus provided with a registering device for automatically setting, in case of using a continuous form such as a fan-fold form or a roll form as the transfer sheet, the perforations in register with the image transfer position.

Still another object of the present invention is to provide a recording apparatus capable of maintaining the image recording position constantly in a position defined with respect to the position of said perforations on the transfer sheet material.

Still another object of the present invention is to provide a recording apparatus capable of detecting the trailing end of transfer sheet material such as a fan-fold form.

Still another object of the present invention is to provide a recording apparatus provided with a latent image measuring zone on said carrying member (for example a photosensitive member) for obtaining a constantly stable electrostatic latent image.

Still another object of the present invention is to provide a recording apparatus provided with a simple and secure automatic loading mechanism which is capable, by means of a chain rotation, of achieving automatic loading of the transfer sheet and actuation of related members in the sheet path in relation to the rotation of a sheet holding member.

Still another object of the present invention is to provide a recording apparatus allowing, in transfer sheet setting, an extremely easy registration of perforations with the image transfer position thereby reducing the trouble of operator.

Still another object of the present invention is to provide a recording apparatus capable of controlling the feeding and stopping of transfer sheet by means of signals obtained from a feed detecting means related with the sheet feeding, thereby constantly stopping the perforations of transfer sheet in substantial register with the image transfer position.

Still another object of the present invention is to provide a recording apparatus provided with a feed control means capable of avoiding paper breakage and paper slack not only during sheet feeding at a constant speed but also at the start and stop of feeding, in case the sheet position is defined in two locations and sheet feeding is conducted in said two locations.

BRIEF DESCRIPTION OF THE DRAWINGS

FIGS. 5 to 8 are drawings of recording patterns obtainable with a recording apparatus embodying the present invention;

FIG. 9 is a schematic cross-sectional view of the automatic loading mechanism;

DESCRIPTION OF THE PREFERRED EMBODIMENTS

Figure 1:
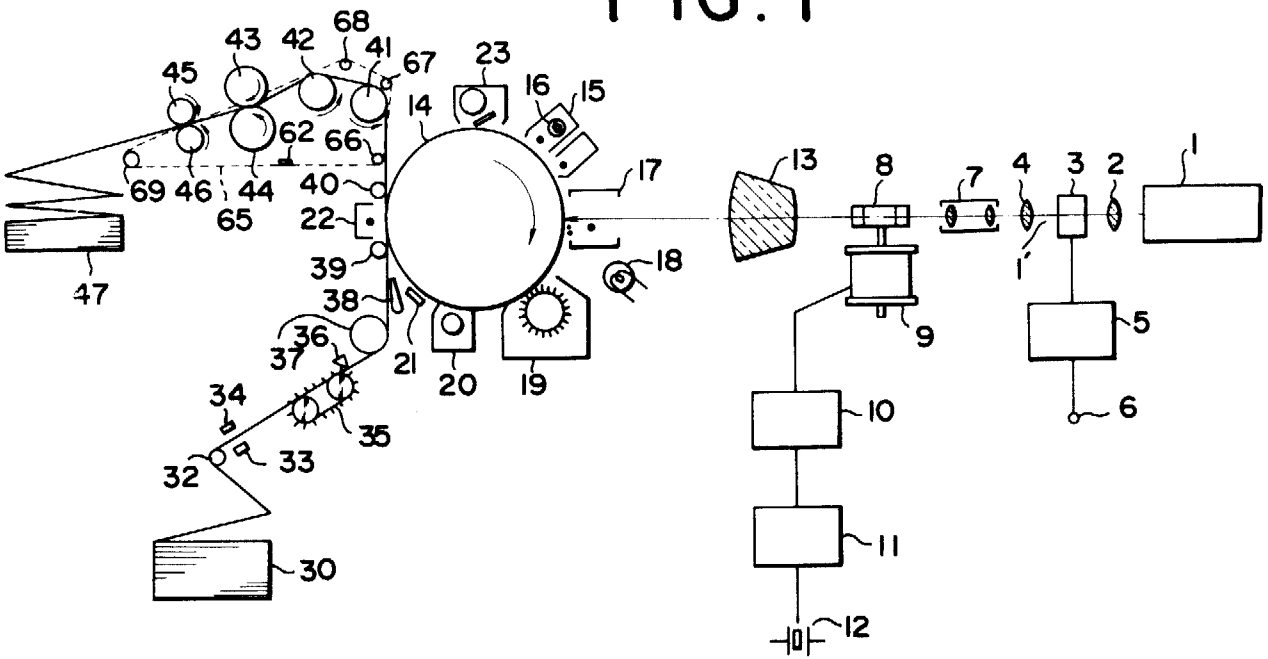
FIG. 1 is a schematic longitudinal cross-sectional view of an embodiment of the recording apparatus of the present invention.

Referring to FIG. 1 schematically illustrating the basic composition of an embodiment of the present invention, there is shown in a laser 1 from which a laser beam is introduced into a light modulation system composed of a lens 2, an acousto-optical modulating element 3 utilizing a known acousto-optical effect and a lens 4, wherein said lens 2 functioning to focus said laser beam onto a Bragg reflecting surface formed in said acousto-optical modulating element, while said lens 4 functioning to convert a diverging beam diffracted by said reflecting surface into a parallel beam.

Naturally said lenses 2, 4 can be dispensed with in case of using an electro-optical modulating element utilizing a known electro-optical effect, and said light modulating system is dispensable in case said laser is for example a gas laser allowing current modulation.

The parallel laser beam emerging from the lens 4 is introduced into a beam expander 7 for enlarging the beam diameter while maintaining the parallel beam state.

The laser beam of thus expanded diameter is then guided to a polygonal rotary mirror 8 provided with one or plural reflecting surfaces, said rotary mirror 8 being mounted on a shaft supported by a high-precision bearing (for example an air bearing) and driven by a constant-rotation motor 9, for example a hysteresis synchronous motor or a DC servomotor. The laser beam, put into horizontal sweeping motion by said polygonal rotary mirror 8, is focused, by means of an imaging lens 13 of an $f-\theta$ characteristic, as a spot onto a photosensitive drum 14. In ordinary imaging lenses, the image position r on the focal plane is related with the incident angle $\theta$ of light through a relation $$r=f\cdot\tan\theta \quad (1)$$

wherein f is the focal length of the imaging lens. Thus, in case of a constant-speed rotation of polygonal rotary mirror 8 as in the present embodiment wherein the incident angle of laser beam (52 in FIG. 2) to the imaging lens 13 changes as a first-order function of time, the displacing speed of focused spot on the photosensitive drum 14 constituting the focal plane is not constant but varies non-linearly, increasing at a larger incident angle. Thus a line of spots obtained by switching on the laser at a constant time interval appears on the photosensitive drum 14 as more distanced in the both ends than in the center portion. In order to prevent this phenomenon the imaging lens is designed to have a characteristic:

$$r=f\cdot\theta \quad (2)$$

such an imaging lens being called an $f-\theta$ lens.

Also in case of focusing a parallel beam with an imaging lens into a spot, the minimum diameter $d_{min}$ thereof is given by:

$$d_{min}=f\lambda/A \quad (3)$$

wherein f is the focal length of imaging lens, $\lambda$ is the wavelength of light used and A is the aperture of imaging lens. Thus a smaller spot diameter $d_{min}$ is obtainable for a larger A in case f and $\lambda$ are constant. The above-mentioned beam expander 7 is inserted for this reason. Consequently the beam expander 7 can be dispensed with in case a necessary beam diameter $d_{min}$ is obtainable with the beam diameter from the laser.

As explained in the foregoing the deflected and modulated beam (52 in FIG. 2) is guided to the photosensitive drum 14, and the resulting image is rendered visible in an electrophotographic process, then transferred and fixed on a plain paper to provide a hard copy.

In an example of an electrophotographic process adapted for use in the present embodiment, a photosensitive member 14 essentially consisting of a conductive substrate, a photoconductive layer and an insulating layer is subjected to a uniform positive or negative charging, on the surface of said insulating layer, by means of a first corona charger 16 thereby also capturing a charge, at the interface between said photoconductive layer and the insulating layer or in said photoconductive layer, of a polarity opposite to that of aforementioned charging. Successively the surface of said charged insulating layer is exposed to said laser beam simultaneously with an AC corona discharge from an AC corona charger 17 thereby forming, on the surface of said insulating layer, a pattern of surface potential difference corresponding to the intensity of said laser beam. Successively the entire surface of said insulating layer is uniformly exposed to a flush exposure lamp 18 to form an electrostatic latent image of an enhanced contrast on said surface, said latent image being rendered visible by development in a developing station 19 with a developer principally consisting of charged colored particles and said visible image being successively transferred by means of a transfer charger 22 onto a fan-fold form (hereinafter represented simply as paper) 30 maintained in contact with the photosensitive drum 14 in a manner as will be explained later and fixed by means of a fixing means to be explained later to obtain an electrophotographic print. On the other hand, the surface of said insulating surface is cleaned in a cleaning station 23 to remove the remaining charged particles thereby preparing the photosensitive member 14 for recycled use.

Also in an another example a photosensitive member essentially consisting of a conductive substrate, a photoconductive layer and an insulating layer is subjected to a uniform positive or negative charging on the surface of said insulating layer by means of a first corona charger, simultaneously capturing a charge, at the interface of said photoconductive layer and insulating layer or within said photoconductive layer, of a polarity opposite to that of said charging. Then said charged surface is subjected to an AC corona discharge thereby attenuating the charge on said surface and is successively exposed to the laser beam carrying the information signal thereby forming an electrostatic latent image on said surface of insulating layer corresponding to the intensity of said laser corresponding to the intensity of said laser beam. The development of said electrostatic latent image can be conducted in a similar manner as in the foregoing example.

In the drawings there are also shown a charger 15 for eliminating retentive charge and a pre-exposure lamp 16. Said charger 15 functions to maintain the surface potential of photosensitive drum 14 constant and uniform, while said pre-exposure lamp 16 functions to maintain the characteristics of photosensitive layer constant and uniform, said members mutually cooperating to eliminate various hystereses such as retentive potential present on the photosensitive drum 14 after passing the cleaning station 23 and thus being effective for constantly obtaining stable images.

Also the present applicant proposes a method of stabilizing the electrostatic latent image as a means for obtaining constant and stable images in the electrophotographic process to be employed in the present invention. 21 is an electrostatic potential meter provided for exploiting such method, and for measuring the electrostatic potentials, on the photosensitive drum 14, in a light area exposed to the scanning laser beam and in a dark area not exposed thereto.

20 is a carrier eliminating station for preventing the deposition of carrier particles, mixed in the developer in the developing station 19, onto the photosensitive drum 14 and adhesion onto the paper or carry-over to the cleaning station 23.

Figure 2:
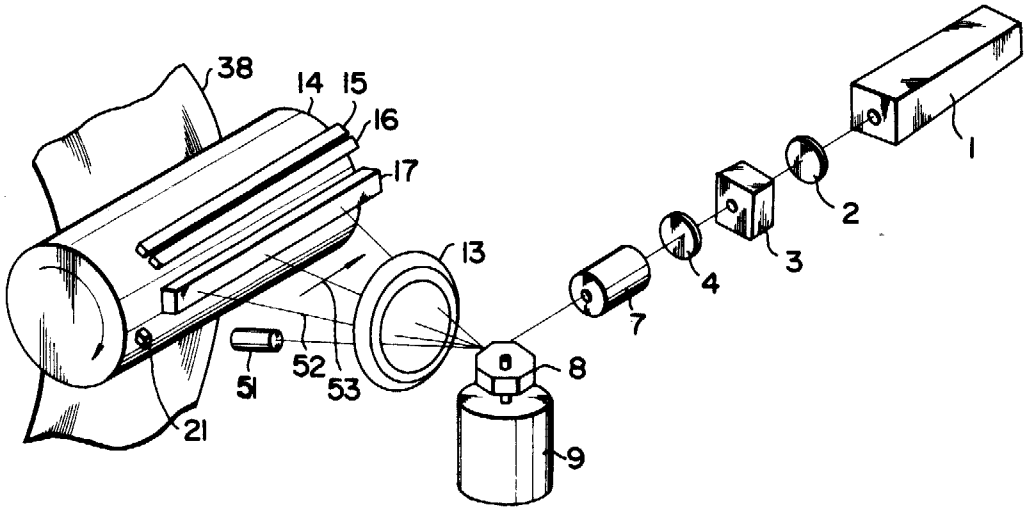
FIG. 2 is an enlarged perspective view of the scanning section thereof.

Referring to FIG. 2 showing the arrangement of optical system of FIG. 1 in a perspective view wherein elements of the same function are represented by the same number, 51 is a beam detector composed of a small inlet slit and a quick-response photo-electric converting element (for example a PIN diode) for detecting the scan start position of the sweeping laser beam 52 and thus generating a detection signal which is utilized, as explained in the following, for determining the start time of modulation control signal for supplying desired optical information to the photosensitive drum 14.

In FIG. 2 the scanning direction of laser beam 52 is represented by an arrow 53.

Now in connection with the paper feeding, 30 is an unprinted paper form provided with feeding perforations along both ends as usually employed for the output from computers.

32 is a holding bar provided for achieving smooth paper feeding, while 33 is a light source such as a light-emitting diode and 34 is a light-receiving element such as a photodiode, both members cooperating to constitute a detector means for detecting the trailing end of paper.

35 is a known tractor provided with pins engaging with said feeding perforartions of paper, said pins being rotated by means of rotation of an unrepresented tractor shaft to advance the paper. 37 is a guide roller for paper feeding.

38 is a separating claw for separating the paper from the photosensitive drum 14 in case the paper is adhered thereto even after the termination of function of transfer charger 22 and the separation of transfer rollers 39, 40 from the drum 14 from a state wherein the paper is maintained in close contact with said drum 14 by means of said rollers 39, 40 and adhered to the drum 14 by the function of transfer charger 22.

As explained above, 39 and 40 are transfer rollers functioning simultaneously in a same direction to maintain the paper in close contact with the photosensitive drum 14. 41 is a guide roller also provided with tension absorbing function in case the paper tension during the feeding thereof significantly deviates from a predetermined value. Also 42 is a pre-heating roller of a hollow tubular shape provided therein with a heat source such as a heater, constituting a fixing station in combination with a fixing roller 43 for fixing the toner transferred onto the paper and a back-up roller 44.

43 is a fixing roller of a hollow tubular shape provided therein with a heat source such as a heater, while 44 is a back-up roller for maintaining the paper carrying transferred toner thereon in pressure contact with said fixing roller 43 thereby facilitating heat transfer to the paper and toner and achieving fixing by applying an elevated pressure to said toner.

45 and 46 are eject rollers for ejecting the paper after completion of fixing, while 47 represents a paper with completed printing.

Figure 3:
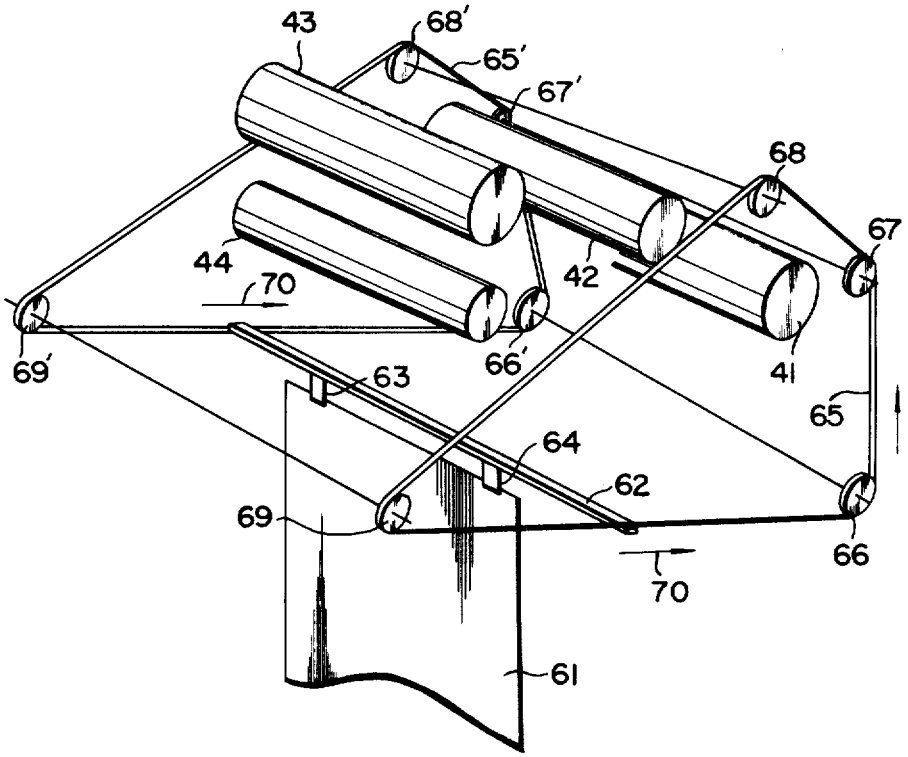
FIG. 3 is a perspective view of an automobile loading mechanism for transfer sheet.

In FIG. 3 there is shown, in a perspective view, an automatic loading mechanism for automatically setting the paper into a section consisting of a guide roller 41, pre-heating roller 42, a fixing roller 43, a back-up roller 44 and eject rollers 45 and 46, said automatic loading mechanism being required because of difficulty of manual setting as the pre-heating roller 42, fixing roller 43 and back-up roller 44 are maintained at an elevated temperature of ca. 180° C. during operation. In FIG. 3 said rollers 45, 46 are omitted since they are functionally equivalent to the fixing roller 43 and back-up roller 44.

In FIG. 3 there are further shown a paper 61, a movable bar 62 fixed to and supported by, at the ends thereof, chains 65, 65' and provided with paper holding means 63, 64 for holding the leading end of paper, chains 65, 65', gears 66, 67, 68 and 69 engaging with said chain 65, gears 66', 67', 68' and 69' engaging with said chain 65'.

The space defined by the chains 65, 65' and gears 66, 67, 68, 69, 66', 67', 68' and 69' is so selected as to include, at the paper setting, the roller 41, pre-heating roller 42 and back-up roller 44 therein but does not include the fixing roller 43.

In this state the paper becomes inserted between the gap between the fixing roller 43 and back-up roller 44 by rotating the chains 65, 65' one full lap in the direction of arrow 70 by means of an unrepresented drive source, with the leading end of paper clamped by the paper holding members 63, 64.

Although the eject rollers 45, 46 are not represented in FIG. 3, it will be apparent that the paper can be threaded through the eject rollers 45, 46 from the roller 41 if said eject rollers 45, 46 are provided respectively corresponding to the fixing roller 43 and back-up roller 44. Also in FIG. 1 there are shown positions of said movable bar 62, chain 65 and gears 66, 67, 68 and 69.

Referring to FIG. 1, the paper threading can be conducted by clamping an end of unprinted paper 30 in the holding members 63, 64 mounted on the movable bar 62, and rotating said chain 65 by means of an unrepresented drive means whereby, upon one full circulation of said chain, the paper being threaded through a gap between the fixing roller 43 and back-up roller 44 and also through a gap between the eject rollers 45, 46. In the above-mentioned operation the fixing roller 43 and the eject roller 45 have naturally to be retracted upward to form said gaps, and, for the purpose of an operation to be explained later, the axes of transfer rollers 39, 40, transfer charger 22 and guide roller 37 are maintained, by means of an unrepresented mechanism, in positions approximately perpendicular to the central axis of the photosensitive drum 14.

Then the pins of said tractor 35 are rendered to engage with the advancing perforations of paper, and the tractor is actuated by means of an unrepresented actuating member to bring the cutting perforations of paper in register with the image transfer position.

Subsequently the transfer charger 22 is brought into the illustrated position wherein the charging wire thereof is parallel to the axis of photosensitive drum 14, and the transfer rollers 39, 40 and guide roller 37 are shifted to a stand-by position wherein the axes thereof are similarly parallel to the axis of photosensitive drum 14 and the paper is distant by several millimeters from the contact position thereof with the photosensitive drum 14. The fixing roller 43 and back-up roller 44 are maintained in positions mutually separate as explained above and also free from contact with the paper, and also the pre-heating roller 42 is maintained in a position not contacting the paper.

The laser beam from the laser 1 is subjected to intensity modulation by the acousto-optical modulating element 3 according to the modulation control signal supplied from an input terminal 6 in a manner to be explained later, and is focused on the photosensitive drum 14 to conduct scanning motion thereon by means of the deflecting function of the polygonal rotary mirror 8.

The print position in the row direction on the paper is adjusted by supplying said modulation control signal after the lapse of a predetermined time from the signal release from a photoelectrical converting element (beam detector) 51 provided corresponding to the scan start position of the deflected laser beam. Said predetermined time can be determined either in digital manner by clock signals employed in data processing devices or by means of a one-shot multivibrator. Also it is possible to use, for this purpose, a clock signal source starting oscillation in response to the signal from the beam detector 51, for example a locked oscillator.

In the above-mentioned methods it is also possible to determine and display said predetermined time in terms of distance, for example in millimeter units, by correlating the oscillation frequency of the signal source such as a clock generator or a locked oscillator with the scanning speed of laser beam.

The advancement of paper is started by the tractor 35 in relation to the timing of start of recording on the photosensitive drum 14.

In general the print position in the column direction with respect to the cutting perforations of paper is arbitrarily selectable, so that the timing of start of paper advancement is determined in relation to a top-of-page signal (hereinafter referred to as TOP signal) to be released prior to the modulation control signal from the data processing device.

More specifically the paper advancement is initiated after the lapse, from the release of said TOP signal, of a determined time $\tau 1$ required for a position on the drum 14 after scanned by the laser beam to reach the image transfer position, said time being dependent on the peripheral speed of drum 14.

As will be apparent from the foregoing explanation, it is possible to adjust the print position in the column direction of paper by varying the time period $\tau 1$ from the release of TOP signal to the time of start of paper advancement. Such adjustment is achievable by a means similar to that employed for the adjustment in the row direction as explained in the foregoing.

In response to the start of paper advancement, the transfer rollers 39, 40 are advanced from the stand-by position toward the photosensitive drum 14 to bring the paper into pressure contact with the drum 14.

Approximately at the same time the transfer charger 22 is put into operation to initiate the image transfer onto the paper.

Also approximately simultaneously with the start of paper advancement, the fixing roller 43 and back-up roller 44 are put into rotation in mutual pressure contact thereby transporting the paper while fixing the toner transferred thereon. The object rollers 45, 46 further advance the paper to provide printed paper 47.

The paper is stopped upon termination of function of tractor 35 and approximately simultaneous termination of rotation of fixing roller 43 and back-up roller 44. The timings of the above-mentioned operations are controlled in such a manner that the cutting perforations of paper becomes placed in register with the image transfer position in order to prepare for the succeeding print operation. Subsequently the fixing roller 43 and back-up roller 44 are displaced to positions not contacting the paper, and the pre-heating roller 42 is also displaced to a similar position. Further, the transfer rollers 39, 40 are displaced to aforementioned stand-by positions and the transfer charger 22 is deactivated, while the separating claw 38 is actuated to separate the paper from the surface of photosensitive drum 14. The photosensitive drum 14 is set into rotation during a predetermined period $\tau 2$ to enable print operation during said period, and, after the lapse of said period $\tau 2$, is further rotated during a predetermined period $\tau 3$ to stabilize the electrophotographic process conditions during said period.

In case the unprinted paper 30 is exhausted, and upon passing of the trailing end of paper through a paper end detector composed of a light source 33 and a light receptor 34, the paper advancement is terminated by a signal released by said light receptor 34 upon receipt of light from said light source 33.

Now there will be given a detailed explanation on the data processing device of the present invention.

Figure 4:
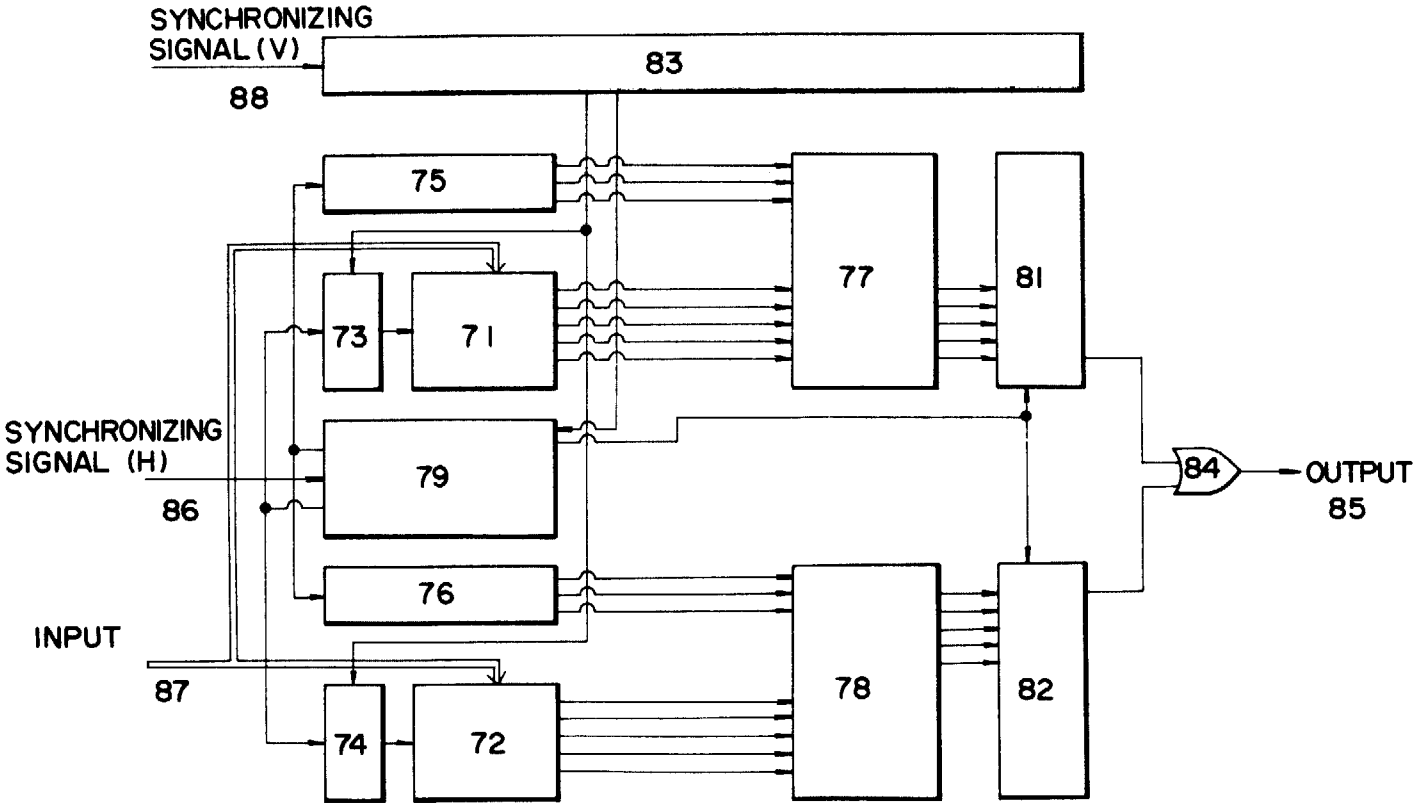
FIG. 4 is a block diagram of a data processing unit.

FIG. 4 shows a block diagram of the circuit of a data processing device embodying the present invention and particularly adapted for providing image or character output signals in the raster scan system thereby supplying modulation control signals to the modulating element 3 used in the laser beam printer shown in FIG. 1.

In said laser beam printer the recording of characters of symbols is achieved by a flying spot 91 (FIG. 5) formed by focusing the laser beam 52 (FIG. 2) onto the photosensitive drum 14, said flying spot performing repeated sweeping motions on the photosensitive drum 14 while receiving an auxiliary scanning in the direction of arrow 93 (FIG. 5) achieved by the rotation of said drum 14 and also a modulation corresponding to each position. The signals for such recording are given by code signals corresponding to characters or symbols, each of said code signals corresponding to each of character units 92.

Figure 5:
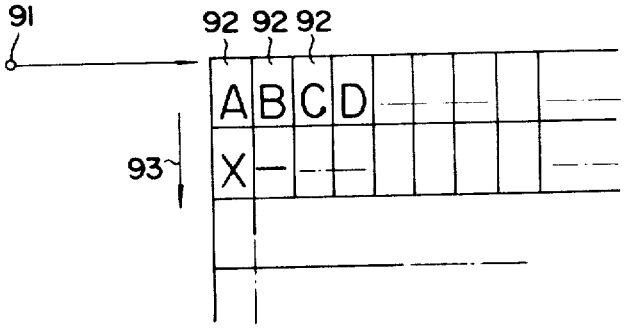

However, since the flying spot 91 covers, in one scanning, only one row in each of the character units arranged to constitute a line in the scanning direction, plural scannings are therefore required for completing the recordings of character units 92 constituting one line. Consequently the modulation of flying spot 91 is not achievable by converting the code signals simply into the corresponding character signals. For this reason the circuit shown in FIG. 4 is designed to obtain desired characters or symbols by the modulation of flying spot as shown in FIG. 5 from the corresponding code signals.

Referring to FIG. 4, there are shown a first memory 71 for memorizing the information corresponding to character units 92 constituting one line in the scanning direction in the form of code signals to be supplied from an input terminal 87, a second memory 72 for memorizing the format codes of the character units 92 constituting one line in the scanning direction, said codes being supplied from the input terminal 87, a first memory control circuit 73 for controlling the write-in and read-out of said first memory 71, a second memory control circuit 74 for controlling the write-in and read-out of said second memory 72, first and second address controllers 75, 76 for designating the rows in the character units 92 constituting one line to be scanned plural times, a first character generator 77 for converting the code information read from said first memory 71 into pattern information and providing parallel outputs of pattern information of a row designated by said first row address controller 75, a second character generator 78 for converting the code information read from said second memory 72 into pattern information and providing parallel outputs of pattern information of a row designated by said second row address controller 76, a first shift register 81 for converting parallel pattern information obtained from said first character generator 77 into serial signals, a second shift register 82 for converting parallel pattern information obtained from said second character generator 78 into serial signals, a timing controller 79 for performing timing control of said first and second memory control circuits 73, 74 and said first and second shift registers 81, 82, a master controller 83 for performing overall sequence control, an OR gate 84, and modulation control output signal 85. The outputs of said shift register 81, 82 are supplied as the modulation output signal to the modulating element 3 through the input terminal 6 and a modulator driver 5.

Figure 7A:
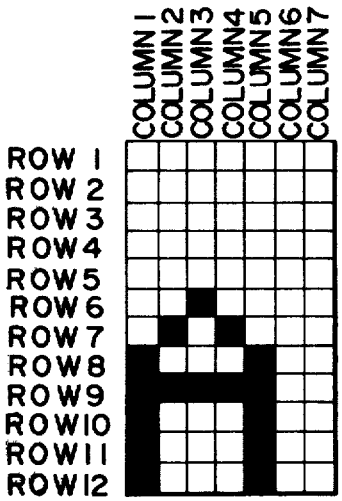
Figure 7B:
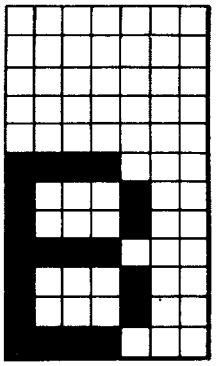
Figure 7C:
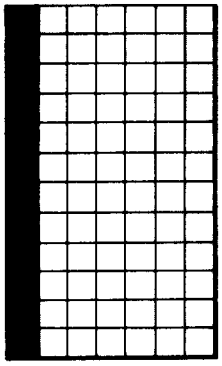
Figure 7D:
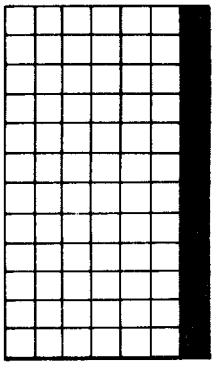
Figure 7E:
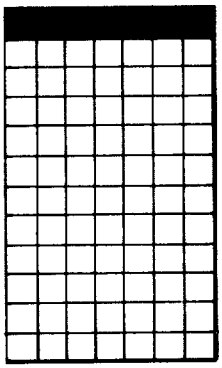
Figure 7F:
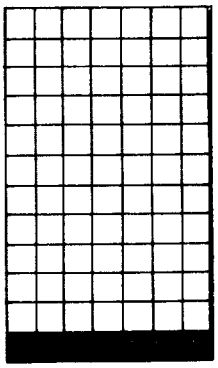

According to the instruction by the master controller 83, the information of one line in a determined format (for example line printer format) is supplied from the input terminal 87 to said first and second memories 71, 72 in the form of code signals and stored therein, said memories 71, 72 respectively memorizing the data information and format information. The data information mentioned above indicates the data to be printed as shown in FIG. 6A, for example output data from a computer, while the format information indicates the recording formats such as frames and titles as shown in FIG. 6B which have generally been preprinted in the paper for conventional line printers. The character generator 77, 78 divide each character unit, as partly illustrated in FIGS. 7A to 7F, into 84 pixels consisting of 7 columns and 12 rows, and release black/white output signals corresponding to the 1st to 7th columns in a row designated by the row address controllers 75, 76. Also as to the format information such as frames, desired patterns can be obtained by coding also special patterns such as a vertical line or a horizontal line as shown in FIGS. 7C–7F in a similar manner as for characters as shown in FIGS. 7A and 7B, and suitably arranging such special patterns in a similar manner as a word is composed from the arrangement of suitable characters.

After storage of code information into the first and second memories 71, 72, the code information for each character is read from the first memory 71 according to the instruction (address and timing) from the first memory control circuit 73 and is supplied to the first character generator 77 thereby designating a pattern therein. Simultaneously the first row address controller 75 releases a signal for designating a row in the pattern designated by said character generator 77. Said first row address controller 75 determines, according to the instruction by the timing controller 79, the row in each pattern designated by said character generator 77, usually designating the rows in each pattern in succession, said designation being renewed for each scanning.

The row pattern information obtained from the character generator 77 in the foregoing manner in a form of parallel output signals is supplied to said first shift register 81 and converted therein into serial bit pattern output signals. The timing of read-out of code signals from the first memory and of pattern input into and output from the first shift register 81 is controlled by the timing controller 79, which is in turn synchronized with horizontal synchronizing signals ((H)86 in FIG. 4) corresponding to each column of character unit 92.

The modulation signal to be supplied to the modulating element 3 is thus obtained from the shift register 81 through the above-explained functions, and the modulation control signal corresponding to the character units 92 constituting one line can be obtained from the output terminal 85 by repeating such functions for the 1st to 12th rows of said character units.

In said functions the timing of the first row address controller 75 is controlled by the timing controller 79 in synchronization with the auxiliary scanning achieved by the rotation of photosensitive drum 14, namely with the vertical synchronizing signals ((V)88 in FIG. 4) corresponding to row in character units 92.

The bit patterns corresponding to the code signals stored in the first memory 81 will provide a recording of data alone as shown in FIG. 6A.

Similarly the code signals stored in the second memory 72 will provide the modulation signals to be supplied to the modulating element 3 in a process identical with that explained in the foregoing, said modulation signals providing a recording of format portion alone as shown in FIG. 6B.

In the circuit shown in FIG. 4, however, the bit patterns obtained from the code signals stored in the first memory 81 and those obtained from the code signals stored in the second memory 82 are respectively provided in parallel from the first and second shift register 81, 82 of which outputs are combined as a logic sum through the OR gate 84. Thus, it is finally rendered possible to obtain a recording including both the data information and format information by controlling the modulating element 3 by means of the output of said OR gate 84.

Although each character unit in the foregoing embodiment is composed of 84 pixels consisting of 7 columns and 12 rows for the purpose of clarity, it will be readily understood that other various structures are also employable in the same manner.

Now let us consider a case where, during the operations explained in the foregoing, the unprinted paper 30 is exhausted and the paper end is detected by the paper end detector 33, 34. In such case the printing operation should be continued until the completion of printing of a page, since the photosensitive drum 14 may be in the course of printing of a page at the time of said detection of paper end. Also at the time of said detection the photosensitive drum 14 may hold thereon the recorded images in a form of electrostatic latent image and in a form of an image developed with toner. Thus, in order to completely finish the printing operation upon detection of paper end, it becomes necessary to further advance the paper by a length $l_3$ after said detection, said length $l_3$ being a sum of a length $l_1$ of paper required for completing the transfer of image present on the drum 14 onto the paper and a length $l_2$ corresponding to the length of paper or information of one page, for example the distance between adjacent cutting perforations on the paper, since said detection of paper end may take place in a worst possible case when the printing operation is located at the start of a page. Further, in order that the paper is stably transported without causing damage to the recording even after said advancement for the length $l_3$ it is indispensable that the pins of tractor 35 are still in engagement with the advancing perforations of paper. Consequently the paper end detector should be provided in a position distant by the length $l_3$ from the tractor 35, which is in turn separated from the actual printing position or image transfer position by a distance $l_0$.

It should further be considered that, even after the detection of paper end and the complete termination of printing operation, there will remain a portion of paper carrying a transferred but unfixed image, from the image transfer position to the fixing position constituted by the contact position between the fixing roller 43 and back-up roller 44. A similar situation will result also in case, without the detection of paper end, of interrupting the printing operation and fixing the thus far performed printing. In order to complete the fixation of the above-mentioned unfixed portion, it becomes naturally necessary to set the fixing station into operation and also to conduct paper advancement in the same manner as in the normal printing operation. For this purpose it is required that the pins of tractor 35 remain engaged with the perforations of paper until the completion of fixation of said unfixed portion of paper. In consideration of this fact, and assuming the effective distance from the fixing position to the image transfer position as $l_4$, the position of said paper end detector should be so selected as to be separated by a distance $l_5$ from the tractor 35, said distance $l_5$ being the sum of said distance $l_4$ and aforementioned length $l_3$.

As a practical example the length $l_1$ is approximately equal to 250 mm in case the photosensitive drum 14 is of a diameter of 160 mm$\phi$ and the angle between the exposure position by the laser beam and the image transfer position is equal to 180°. Also $l_2$ can be considered of about 356 mm of 14 inches as the usual paper length is in a range of 11 to 14 inches. Thus $l_3$ is equal to 606 mm. Also in the embodiment of the present applicant $l_4$ is approximately equal to 400 mm while $l_0$ is 200 mm, so that the distance $l_5$ is equal to 1006 mm.

Automatic Loading Mechanism

Now there will be given a detailed explanation on the automatic loading mechanism while making reference to FIG. 9 which gives a view from a direction perpendicular to the plane formed by the chain 65, wherein the guide roller 41, pre-heating roller 42 and eject rollers 45, 46 being omitted for clarity.

Figures 8, 9:
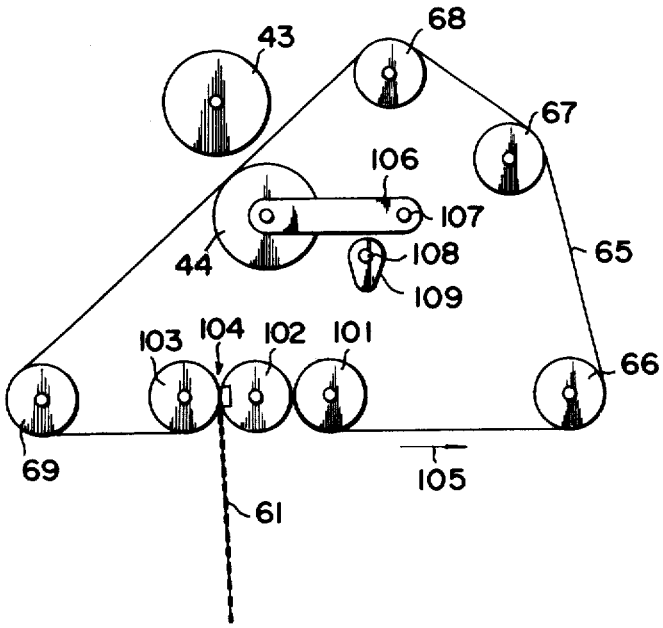
Figure 10:
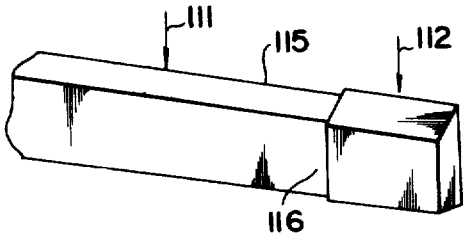
FIGS. 10 and 11 are respectively a perspective view and a cross-sectional view of a movable bar in the automatic loading mechanism.
Figure 11:
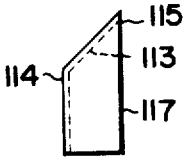

In FIG. 9 there are shown gears 101, 102 and 103 engaging with the chain 65, said gears 101 and 102 or 102 and 103 being structured to simultaneously engage with said chain in position where said gear are facing each other, and a movable bar 104 of which shape is given in a perspective view in FIG. 10 and cross-sections corresponding to the points 111, 112 in FIG. 10 as shown in FIG. 11, said bar being provided with a ridge portion 115 of a narrow angle and an end portion 116 whereby correct positioning of paper being achieved by placing the perforations of paper over said ridge portion and maintaining a side end of paper in abutment with said end portion 116.

Said bar is mounted on the chain 65 by an unrepresented mechanism in such a manner that an end face 117 (shown in FIG. 11) is constantly parallel to the advancing direction of the chain 65.

Referring to FIG. 9, the paper is set on the movable bar 104 in a manner as explained in the foregoing, and is fixed thereto by means of unrepresented holding means.

Subsequently the chain 65 is rotated in the direction of arrow 105 by means of an unrepresented drive source until the chain returns to the original position after one complete circulation, whereby the paper becomes threaded through a gap between the fixing roller 43 and back-up roller 44 in a manner as explained in the foregoing.

On the other hand, when the automatic loading mechanism is not in operation, the back-up roller 44 is rotatably supported by arms 106 which are in turn rotatable around an axis 107 between a position 1 wherein the back-up roller is maintained in pressure contact with the fixing roller 43 and a position 2 wherein the paper can be threaded therebetween.

An eccentric cam 109 rotatable around an axis 108 is maintained in contact with said arm 106 during the operation of said automatic loading mechanism, while the rotation of said eccentric cam 109 allows the arm 106 to descend thereby allowing the back-up roller 44 to assume a position showing a gap larger than that in said position 2. Said axis is designed to perform approximately one rotation during one full circulation of the movable bar 104 by means of unrepresented gear combination meshing with the chain 65.

Furthermore, said eccentric cam 109 is positioned with respect to the arm 106 in such a manner that, upon arrival of movable bar 104 at the vicinity of contact portion between the fixing roller 43 and back-up roller 44 during the circulation of said movable bar, the back-up roller assumes a farthest position 3 from the fixing roller 43 by said eccentric cam 109 in order to allow passing of said movable bar therebetween.

The shape of said eccentric cam 109 shown in FIG. 9 is suitable for allowing the passage of movable bar 104 between the fixing roller 43 and back-up roller 44, but it is easily possible to pass the movable bar 104 also through the gap between the eject rollers 45, 46 by modifying the shape of eccentric cam 109 and suitably selecting the mutual position of the cam 109 with respect to the arm 106.

In such structure as explained above, the back-up roller 44 assumes the position 1 or 2 in normal operation and assumes the position 3 at the automatic loading function.

Top-of-Page-Registration Mechanism

Figure 12:
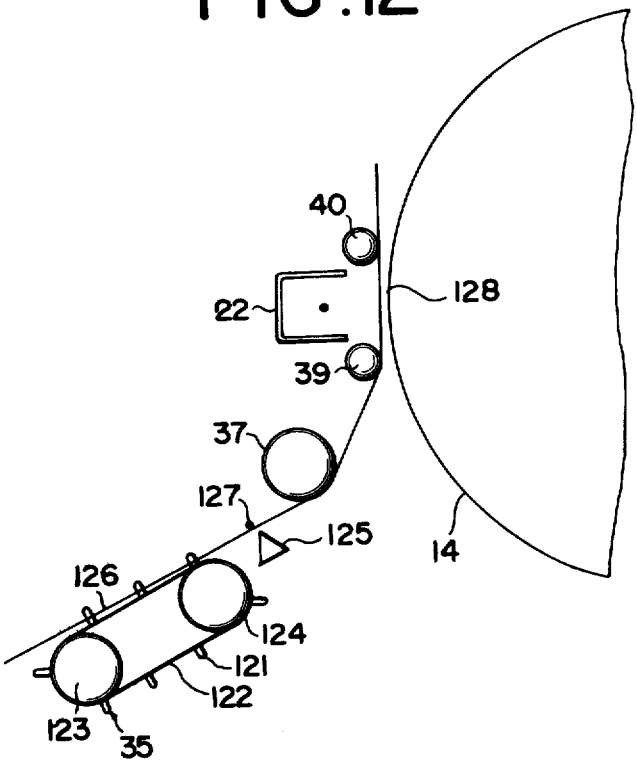
FIGS. 12 and 13 are cross-sectional views of first and second embodiments of the page-top registering mechanism.

Now there will be given an explanation on the page register mechanism while making reference to FIG. 12, wherein components functionally corresponding to those in FIG. 1 are represented by corresponding numbers and wherein there is shown a tractor 35 composed of pins 121 to engage with the advancing perforations of paper 126, a belt 122 provided with a plurality of said pins 122, and pulleys 123, 124 for rotating said belt 122; an index 125 for registering the cutting perforations of paper 126; a paper 126 provided with cutting perforations 127 indicated by a circle; and an effective printing position of image transfer position 128 which is determined by the structure, operating conditions etc. of transfer charger 22 and the positional relationship of rollers 39, 40 and photosensitive drum 14.

The paper setting is achieved in the following manner. After the paper is threaded through the fixing station by means of the automatic loading mechanism in the above-mentioned manner, the transfer charger 22 is set into position, and the feeding perforations of paper are engaged with the pins 121 of tractor 35 which is then rotated by an unrepresented mechanism thereby bringing the cutting perforations of paper 126 in register with the index 125.

The feeding perforations provided along the paper 126 are mutually spaced by 0.5 inches according to the international standard applicable to the form paper for such purpose.

Thus, if the distance from the image transfer position 128 to the index is selected as a multiple of 0.5 inches, it will be apparent that the cutting perforations can be brought into register with said transfer position when the paper is advanced by the above-mentioned distance, by means of an unrepresented mechanism.

However, such distance is not necessarily limited to a multiple of 0.5 inches, and such registration is also achievable by correlating the rotation angle of pulleys 123, 124 of tractor 35 with the aforementioned distance.

Figure 13:
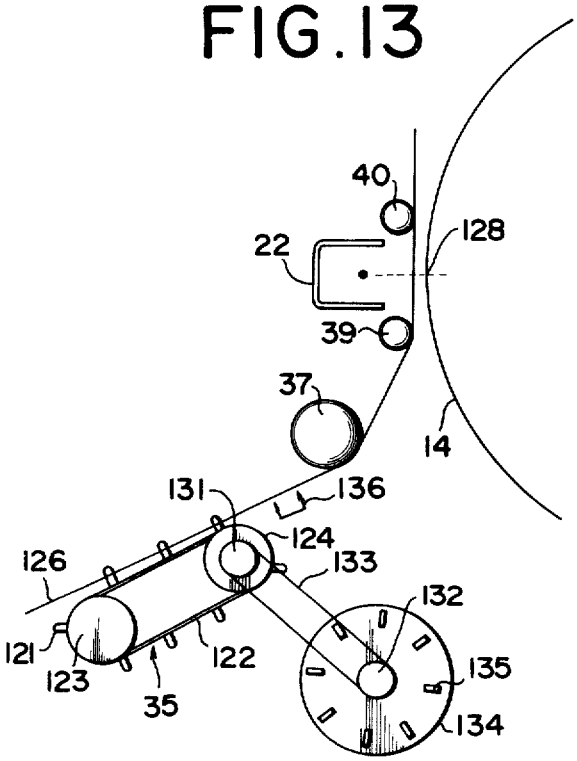

Now reference is made to FIG. 13 showing an another embodiment of the top-of-page registration mechanism, wherein there are shown a pulley 131 mounted coaxially with the pulley 124, an another pulley 132 linked with said pulley 131 by means of a belt 133, and a disc mounted coaxially with said pulley 132 and provided with equally spaced slits 135 along the periphery thereof.

136 indicates an index which, in contrast to that in the foregoing embodiment wherein the cutting perforations have to be brought into register with a substantially single point, has a tolerance narrower than the pitch of feeding perforations wherein an automatic top-of-page registration is rendered possible by the function to be explained later as long as the cutting perforations of paper are brought within a range indicated by the arrows.

A pitch between adjacent slits 135 is selected in such a manner that the paper is advanced by 0.5 inches by said pulleys 131 and 132, and there is provided an unrepresented slit detector consisting for example of a light source such as a light-emitting diode and a light receptor such as a photodiode arranged on both sides of the disc 134 to generate a signal upon each advancement of paper by 0.5 inches and upon each registration of cutting perforations with the image transfer position.

The operation of the present embodiment is as follows. At first it is assumed that the cutting perforations of paper are placed in an arbitrary position within the range indicated by the two arrows. In the subsequent advancement of paper by an unrepresented means, the first output signal from the slit detector is evidently obtained, from the relationship between the aforementioned slits 135 and image transfer position 128, when said performations are distanced from the image transfer position by a multiple of 0.5 inches. Thus the cutting perforations of paper can be brought into register with the image transfer position by advancing the paper until a predetermined number of pulses is obtained from said slit detector.

Paper Transport Mechanism

Figure 14:
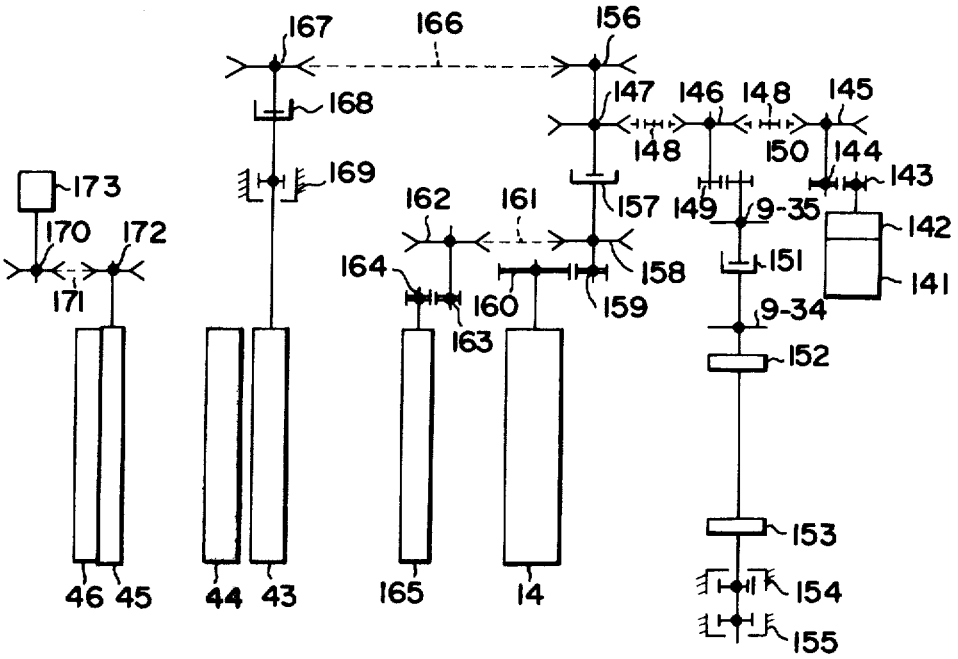
FIGS. 14 and 15 are drive circuit diagrams for the paper feed device.

Now there will be given a detailed explanation on the paper transport mechanism. Referring to FIG. 14 there are shown a main motor 141 of a constant revolution such as a speed-controlled DC motor or a synchronous motor which is required to maintain a constant relationship between the paper advancing speed and rotation speed of aforementioned polygonal rotary mirror as the laser beam scanning in the present embodiment is conducted by said rotary mirror independently from the paper advancing; a reducing gear 142; gear 143, 144 meshing with each other; a pulley 145 mounted coaxially with said gear 144; other pulleys 146, 147, said three pulleys meshing with a timing belt 148; a gear 149 mounted coaxially with said pulley 146; a gear 150 meshing with said gear 149; a clutch 151 for example a magnet powder clutch with a transmission torque variable by the current supplied thereto; known tractors 152, 153 provided pins engaging with the feeding perforations of paper; brakes 154, 155; a sprocket 156 mounted coaxially with said pulley 147; a clutch 157 for example a magnet powder clutch; a sprocket 158; a gear 159 mounted coaxially with said pulley 158; a gear 160 meshing with said gear 159 to rotate a photosensitive drum 154; a chain 161 engaging with a sprocket 162 and above-mentioned sprocket 158; a gear 163 mounted coaxially with said sprocket 162; a gear 164 meshing with said gear 163 to rotate a developing roller 165 which is an external rotary sleeve provided therein with stationary magnet poles to constitute a known magnet brush developing device; a chain 166 for linking said sprocket 156 with a sprocket 167; a clutch 168 with a variable transmission torque such as a magnet powder clutch; a brake 169 coaxially provided with a fixing roller 43; pulleys 170, 172 linked by a timing belt 171, said pulley 172 being provided with a paper eject roller 45; and a motor 173.

Figure 15:
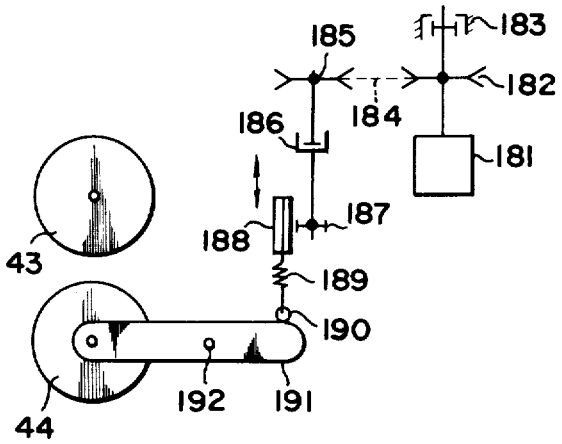

Now referring to FIG. 15 showing the drive mechanisms relating to the pressure contact between the fixing roller 43 and back-up roller 44 in order to explain the function of fixing station, there are shown a drive motor 181; a sprocket 182 coaxially provided with a brake 183; a chain 184 for linking sprockets 182 and 185; a clutch 186; and a ball screw 187, 188 wherein a shaft 188 is linearly displaced in the direction of the arrow P upon rotation of a screw 187 thereby pressing, through a spring 189 and a pressure roller 190, an arm 191 rotatably supporting the back-up roller 44, said arm 191 being provided with a support shaft 192 so that a downward displacement of said roller 190 in the drawing brings the back-up roller 44 into pressure contact with the fixing roller 43.

Said spring 189 is so selected that the back-up roller is maintained in contact with the fixing roller 43 with a predetermined pressure when the shaft 188 is displaced by a predetermined distance.

Figure 16:
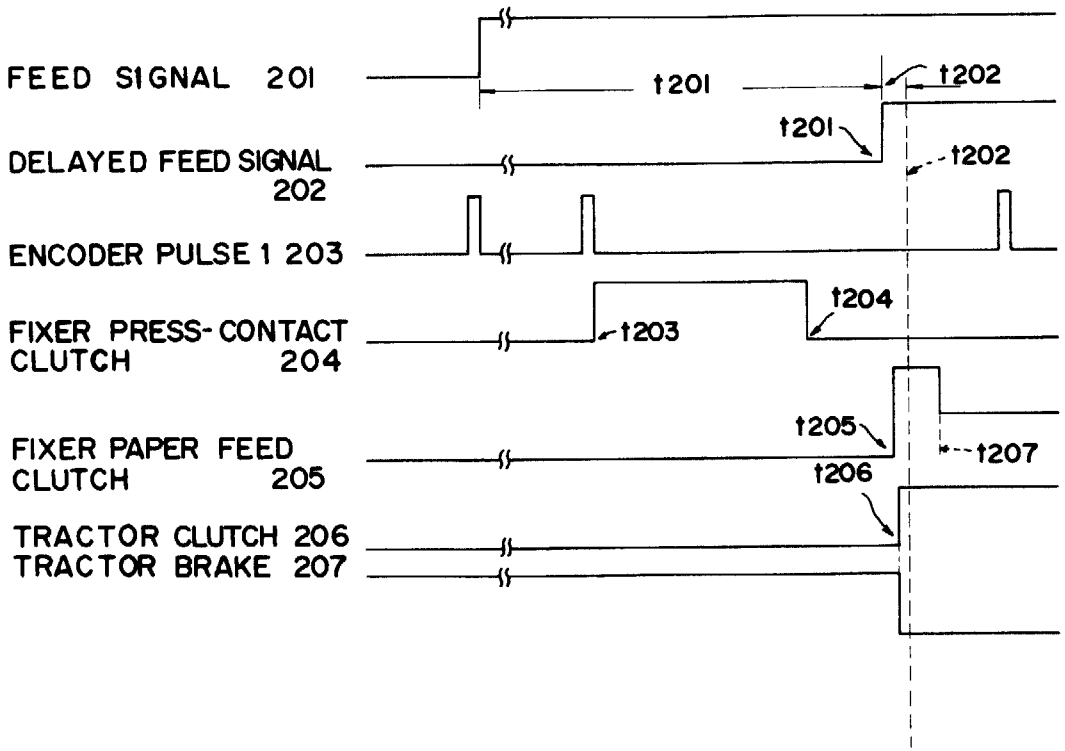
FIGS. 16 and 17 are signal charts showing the drive timings of said paper feed device.
Figure 17:
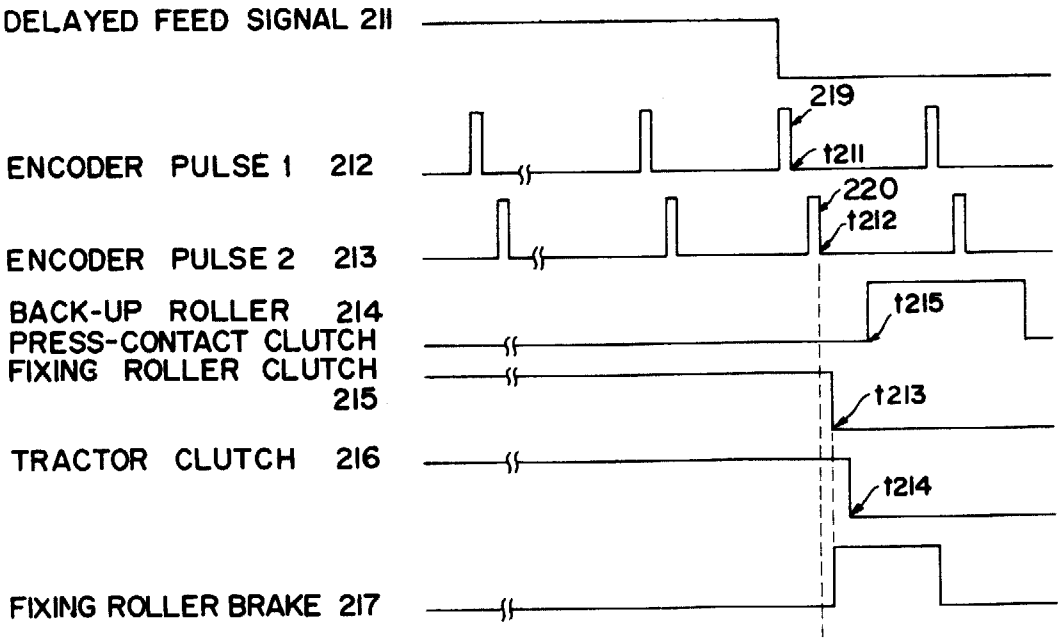
Figure 19:
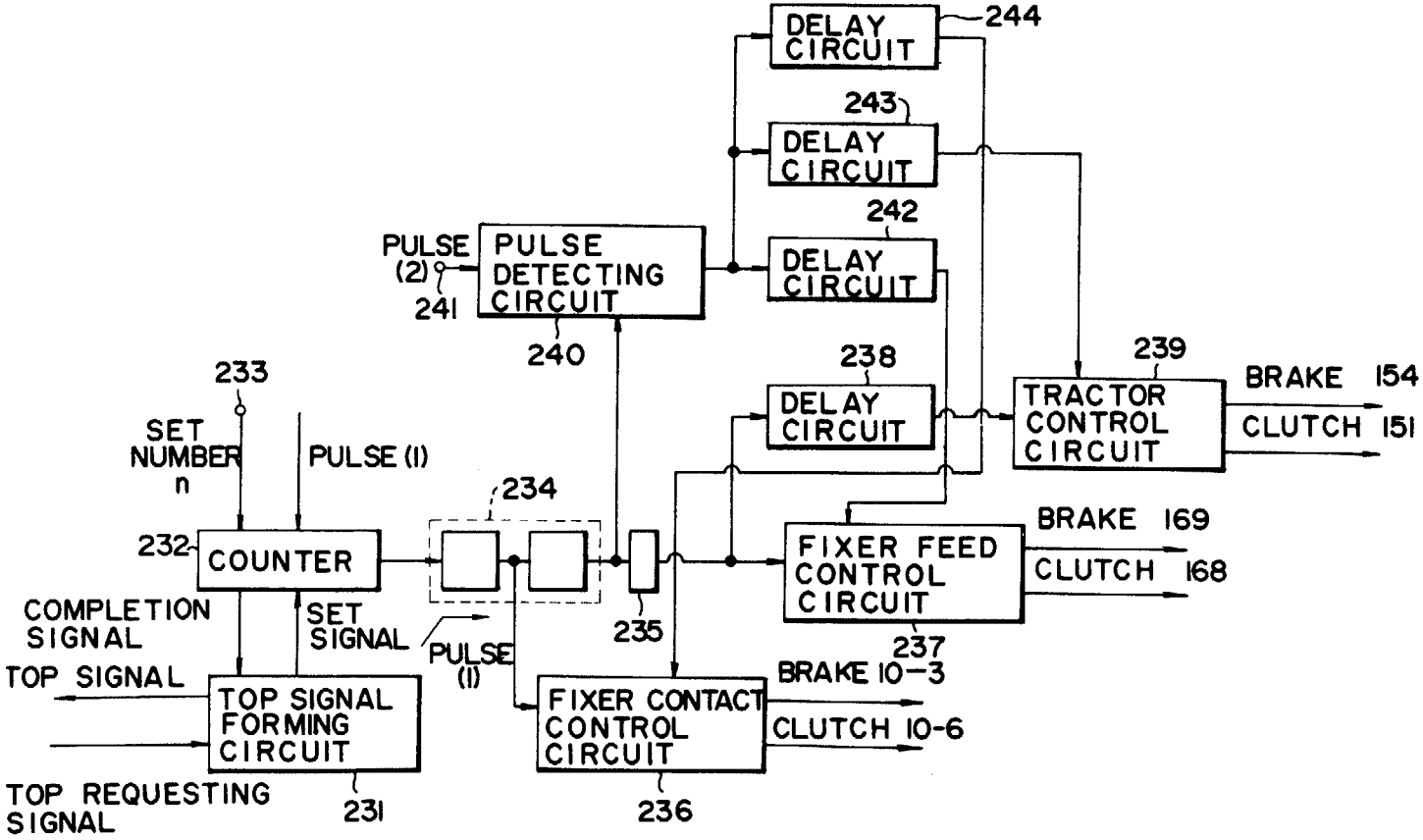
FIG. 19 is a control circuit diagram for paper feed device.

FIG. 16 and 17 show the relation in time of start and stop of paper transport in connection with the function of components shown in FIG. 14, and FIG. 19 shows a control circuit therefor.

In FIG. 14, upon supply of a start signal from a data processing device to the printing apparatus after power supply thereto is turned on, the main motor 141 is set into rotation which is transmitted through the reducing gear 142 and gears 143, 144 to the pulley 145 which in turn rotates the pulleys 146, 147 through the timing belt 148. The pulley 146 rotates the disc 175 through the gears 149, 150 while the sprocket 156 rotates the sprocket 167 through the chain 166. In this state the clutches 151, 157 and 168 are disconnected.

The main motor has a revolution of approximately 1500 rpm, while the reducing gears 142 has a reducing ratio of 1:10. The timing belt 148 is required to correlate the rotation of photosensitive drum 14 and of paper transport tractors 152, 153 exactly with the rotation speed of main motor, and the chain 166 is also employed for a similar reason. In this manner the advancing speed of paper is rendered constant and corresponding to the angular velocity of the photosensitive drum 14, and the drive power for the drum 14, tractors 153, 154 and fixing roller 43 is obtained from the main motor 141 in order to avoid abnormal tension on the paper at the transport thereof. The brake 154 for the tractors is simultaneously energized to prevent premature rotation of tractors 152, 153, while the brake 155 is structured to be released when a current is supplied thereto.

Also an unrepresented heater provided in the fixing roller 43 is simultaneously activated, and the motor 9 is set into rotation by means of a servo circuit 11 and a motor drive circuit 10, based on the signals from a crystal oscillator 12. Furthermore there is initiated the function of laser 1 and other components.

Upon arrival of the motor 9 at a predetermined revolution, arrival of the surface temperature of fixing roller 43 at a predetermined value to be detected by an unrepresented thermal detector and arrival of various components at a stable functioning state, the printing apparatus releases a print ready signal to the data processing device. More specifically said print ready signal is released when the printing apparatus show no abnormality for printing operation, namely upon detection of arrival of the surface temperature of fixing roller 43 at a predetermined value, detection of motor rotation at a predetermined speed, absence of paper end detection by the paper end detector 33, 34, and detection of correct paper setting in the path therefor, and there are provided various detecting circuits for performing such detections, such as the above-mentioned thermal detector (not shown) for detecting the surface temperature of fixing roller, paper end detector 33, 34, an unrepresented automatic toner detector for detecting if the developing station 19 contains a predetermined quantity of toner, an unrepresented reserve toner detector for detecting if a toner container for supplying toner to the developing station contains a predetermined quantity of reserve toner etc.

Upon receipt of said print ready signal, the data processing device releases a start signal to the printing apparatus.

Upon receipt of said start signal the clutch 157 is actuated to initiate pre-rotation of photosensitive drum 14 and to set a pre-eliminating charger 15 and a pre-exposure lamp 16 into function thereby realizing a uniform surface potential of drum 14 and stable characteristics of the photosensitive layer thereof.

Upon completion of said pre-rotation the printing apparatus releases a TOP signal.

Figure 18:
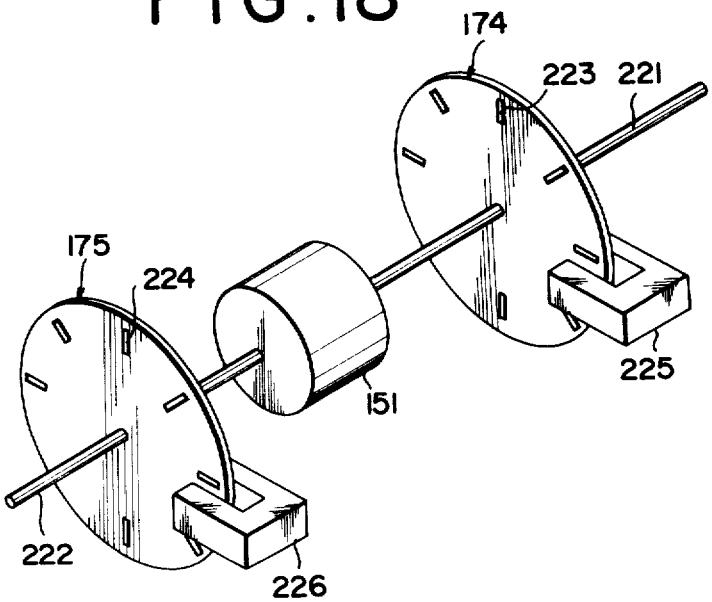
FIG. 18 is a perspective view of a pulse generator.

Said TOP signal is released in synchronization with an encoder pulse (1) obtained from the slit detector provided in combination with the disc 175. FIG. 18 shows the structure of said discs 174, 175 wherein there are shown a shaft 221 connected to the tractor 152, a shaft 222 connected to the gear 150, slits 223 provided on the peripheral portion of said disc 174, and slits 224 similarly provided on the disc 175.

225 and 226 are slit detectors each composed of a light emitter and a light receptor mutually facing with the disc 225 or 226 placed between, said slit detector 225 or 226 releasing an encoder pulse (2) or (1) when a slit becomes positioned in the light path from said light emitter to the light receptor.

Each disc is provided with eight equally spaced slits as a full rotation of shaft 221 causes the tractors 152 and 153 to advance the paper by 4 inches, so that the time interval of succeeding encoder pulses (1) or (2) corresponds to a paper advancement of ½ inches.

It is to be noted that the above-mentioned relation between the amount of paper advancement and the interval of encoder pulses (1) or (2) is arbitrarily selectable in relation for example to the pitch of feeding perforations on the paper, and that the discs 175 and 176 may be provided with mutually different numbers of slits.

Said disc 175 is mounted on the shaft 221 in such a manner that the cutting perforations of paper coincide with the effective image transfer position upon detection of a slit 223 by the slit detector 225.

Such structure as explained above is not only useful in the paper feed control to be explained later but also effective in paper setting on the printing apparatus.

For example in the apparatus shown in FIG. 1 it is easily possible to stop the paper with the cutting perforations thereof in register with the image transfer position by providing the index 36 at a position distanced from said transfer position along the paper path by a predetermined multiple of ½ inches, then bringing the cutting perforations of paper into register with said index 36 at paper setting and counting the encoder pulses (1) in relation to the above-mentioned multiple while advancing the paper by the tractor 35 (152, 153 in FIG. 14) with the pins thereof engaging with the feeding perforations of paper. In this manner it is possible to achieve the paper feed control to be explained later and also to achieve the top-of-page registration.

Upon receipt of said TOP signal, the data processing device initiates the supply of modulation control signals, thereby conducting recording by exposure on the photosensitive drum 14.

Simultaneously with the release of TOP signal, the printing apparatus initiates counting of encoder pulses (1) by a counter 232, and, based upon the paper length information indicating the length of one page between the succeeding cutting perforations on the paper, generates a feed signal which is a pulse starting from the release of said TOP signal and continued during a period corresponding to the length of a page (201 in FIG. 16). Said paper length information is supplied from a terminal 233 to said counter 232.

The above-mentioned feed signal is supplied to a delay circuit 234 composed of a shift register.

Although said feed signal is continued during a period corresponding to the length of paper from said TOP signal, the TOP signal forming circuit 231 detects, upon receipt of a count end signal from the counter 232, the presence of a top demand signal which may be released by the data processing device at the end of exposure of one page, and releases a set signal to set a predetermined number in said counter when said top demand signal is present, whereby the printing apparatus releases a TOP signal for the next page and renews the feed signal for a period corresponding to the paper length for the next page. In this manner the printing is performed by signal communication between the printing apparatus and data processing device for each page.

Formation of Paper Feed Signal

The feed signal 201 shown in FIG. 16 is delayed in the delay circuit 234 by a time $\tau$201 to form a delayed feed signal 202.

Said time $\tau$201 is determined in relation to the angular velocity of photosensitive drum 14 and is selected shorter than the time $\tau$203 required for an image recorded on the drum 14 in the exposure position to reach the effective image transfer position. The time $\tau$201 is for example determined by counting the encoder pulses (1) by the counter 232.

The effective start time $\tau$203 for paper feeding is further delayed by a period $\tau$202 from the release of said delayed feed signal $\tau$201, so that $\tau 203 = \tau 201 + \tau 202$. The period $\tau$202 is determined by a one-shot multivibrator or a shift register. The shift register 234 is provided with a one-shot multivibrator 235 releasing an output signal of which leading edge coincides with the leading edge of delayed feed signal 202 and of which trailing edge coincides with the time $\tau$205, and the printing can be initiated from the time $\tau$202 when the time constant is selected in such a manner. In this manner it is possible to adjust the distance from the top of page or cutting perforations to the print start position by modifying the period $\tau$202 with a variable one-shot multivibrator.

On the other hand the shift register 234 actuates, at a time $\tau$203 delayed by a predetermined period from the feed signal 201, a fixing control circuit 236 to energize the clutch 186 for bringing the back-up roller 44 into pressure contact with the fixing roller 43 and to release the brake 183, whereby the rotation of motor 181 is transmitted through the sprocket 182, chain 184, sprocket 185, clutch 186 and screw 187 and converted to a vertical displacement of the shaft 188. Said displacement is transmitted through the spring 189, roller 190 and arm 191 rotating about the axis 192 to bring the back-up roller 44 into pressure contact with the fixing roller 43. The above-mentioned operation is completed at the time $\tau$204. The time $\tau$203 is determined by counting a predetermined number of encoder pulses (1) from the release of said feed signal 201 by means of said shift register 234.

Then at the trailing edge of output signal $\tau$203 from said one-shot multivibrator which is prior to the time $\tau$202 but after the time $\tau$201, a fixer feed control circuit 237 for driving the fixing roller 43 is actuated to energize the clutch 168 and to release the brake 169 thereby setting the fixing roller 43 into rotation.

In case the clutch 168 is provided with a variable transmission torque according to the current supplied thereto, for example a magnet powder clutch, said current is selected by said fixer feed control circuit 237 so as to allow transmission of a torque, from the time $\tau$205 to $\tau$207, larger than that required for constant and continuous paper feeding (as shown by 205 in FIG. 16 wherein the ordinate indicates current) in order to expedite the start of rotation of fixing roller 43.

Then at a time $\tau$206 later than the time $\tau$205 the cluth 151 is actuated and the brake 154 is released whereby the tractors 152, 153 initiate the paper feeding.

Such operation is achieved by supplying the output of said one-shot multivibrator to the delay circuit 238 and controlling the tractor control circuit 239 by means of the output from said delay circuit 238.

The above-mentioned $\tau$205, $\tau$206 and $\tau$207 are determined so as to maintain the paper tension during the paper transport at a value lower than the paper breaking tension and at the same time to shorten the induction period of paper transport as far as possible.

Approximately simultaneously with the time $\tau$202 the transfer charger 22 is activated by means of an unrepresented high-voltage relay, and the transfer rollers 39, 40 and separating claw 38 are also actuated so as to be pressed against the photosensitive drum 14.

Also the eject roller 45, driven by the torque motor 173 through the sprocket 170, chain 170 and sprocket 172, removes the paper under a constant tension from the contact portion between the fixing roller 43 and back-up roller 44.

The top margin or the distance from the cutting perforations of paper to the print start position is arbitrarily determinable by fine adjustment of the period $\tau$202 in the one-shot multivibrator as explained in the foregoing, while the left margin defining the print start position in the row direction is also adjustable by controlling the time of supply of modulation control signal from the data processing device to the printing apparatus.

More specifically it is rendered possible to adjust the left margin and top margin at the printing apparatus by a structure in which a delayed signal obtained by a one-shot multivibrator or by a means for counting clock signals after the release of an output signal from the beam detector 51 is supplied to the data processing device, and upon receipt of said delayed signal the data processing device initiates the supply of modulation control signals immediately or after a predetermined period.

In the following an explanation will be given on the termination of paper feeding. When the printing is to be interrupted, the data processing device terminates the release of top demand signal. Because of the absence of supply of top demand signal to the top signal forming circuit 231, the counter 232 terminates the release of output signal of number counting while the printing apparatus terminates the recording on the photosensitive drum 14 at the time $\tau 211$. There is provided a pulse detecting circuit 240 for detecting the first encoder pulse (2) after the delayed feed signal is cancelled, a terminal 11 of said circuit receiving the encoder pulses (2) for this purpose. The operation for terminating paper feeding is initiated at the time $\tau 212$ of thus detected encoder pulse (2) 220.

The output of said pulse detecting circuit 240 is delayed by a predetermined period in a delay circuit 242, and thus controls the aforementioned fixer feed control circuit 237 at the time $\tau 213$ delayed by a predetermined period from the time $\tau 212$ thereby releasing the clutch 168 of fixing roller and approximately simultaneously actuating the brake 169 (215 and 117 in FIG. 17).

Although the paper is still advanced for a while because of the inertia of driving mechanisms such as the fixing roller 43, back-up roller 44 etc., the clutch 151 (216 in FIG. 17) of tractor is released and the brake 154 is actuated at the time $\tau 214$ when the paper advancement is almost stopped thereby completely terminating the paper feeding. Such control is achieved by supplying the output of said pulse detecting circuit 240 to the delay circuit 243, and by controlling said tractor control circuit 239 by the output of said delay circuit.

The timings of the above-mentioned operation are selected in such a manner that the paper is stopped at a position wherein the cutting perforations thereof coincide with the image transfer position and the paper is free from abnormal tension or slack in the stopped state.

Subsequently the clutch 186 is released at the time $\tau 215$ whereby the ball screw composed of the gear 187 and shaft 188 is inversely rotated to separate the back-up roller 44 from the fixing roller 43 and maintain the back-up roller in the stand-by state. The above-mentioned control can be achieved by supplying the output of said pulse detecting circuit 240 to the delay circuit 244 and by controlling the aforementioned fixer pressure control circuit 236 by the output of said delay circuit.

Also approximately at the time $\tau 214$ the power supply to the transfer charger 22 is terminated by an unrepresented high-voltage relay, while the transfer rollers 39, 40 are separated from the photosensitive drum 14 and the paper is completely separated from the periphery of said drum 14 by means of the separating claw 38.

The termination of paper feeding is controlled, in the above-explained manner, by the encoder pulses (2) because said pulses (2) are exactly generated when the cutting perforations of paper coincide with the effective image transfer position, so that the printed image can be maintained at a fixed relationship with respect to the cutting perforations even after repeated stops of paper advancement.

The paper feeding is terminated by the above-explained operation, but the photosensitive drum 14 continues a stand-by rotation under normal operating conditions for a predetermined period from the paper stop time $\tau 214$, during which period the printing can be immediately restarted by the start signal from the data processing device.

Stated differently the printing apparatus maintains a stand-by state for a while, even after the termination of paper feeding, to enable immediate print start upon receipt of start signal from the data processing device. In the presence of such start signal during such stand-by state the recording is immediately started while in the absence of such start signal the printing apparatus is stopped after a post-rotation for rendering the process conditions constant. In case of receipt of said start signal during said post-rotation, the apparatus returns to the aforementioned pre-rotation state after which the ordinary printing operation is initiated.

Paper End Detecting Mechanism

Figure 20:
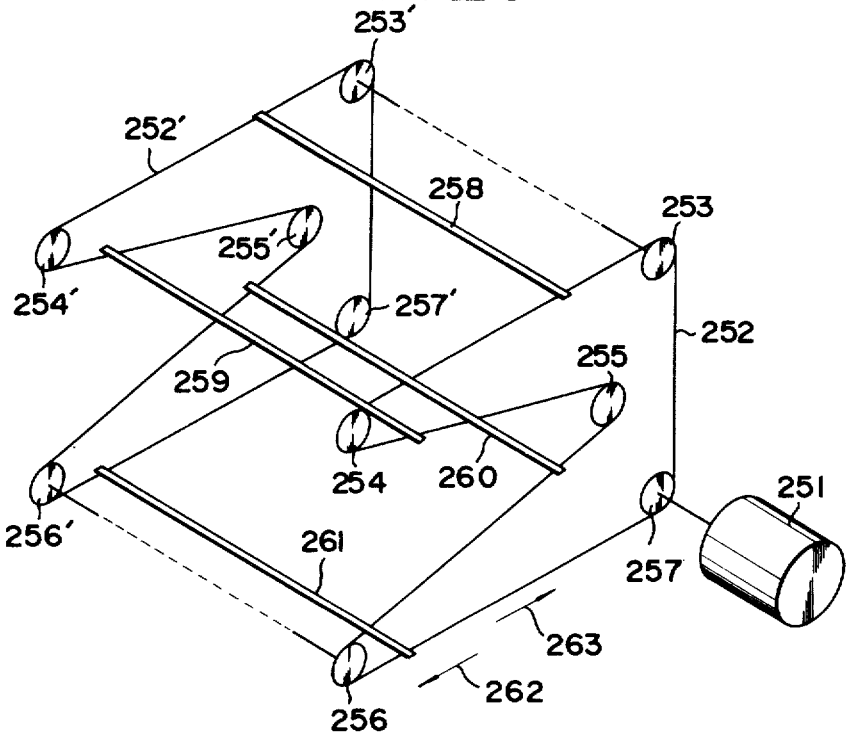
FIG. 20 is a perspective view of a detecting device for trailing end of paper.

Referring to FIG. 20 showing an embodiment of the paper end detecting mechanism, there are shown a drive motor 251, a chain 252 meshing with gears 253, 254, 255 and 256 which are driven by said chain, a chain 252' meshing with gears 253', 254', 255' and 256' which are driven by said chain, said gears 253, 254, 255 and 256 being respectively connected with gears 253', 254', 255' and 256' by means of unrepresented shafts, and movable bars 258, 259, 260 and 261 mounted on said chains in the positions to be explained later, the direction of circulation said chains being represented by the arrows 262 and 263.

Figure 21:
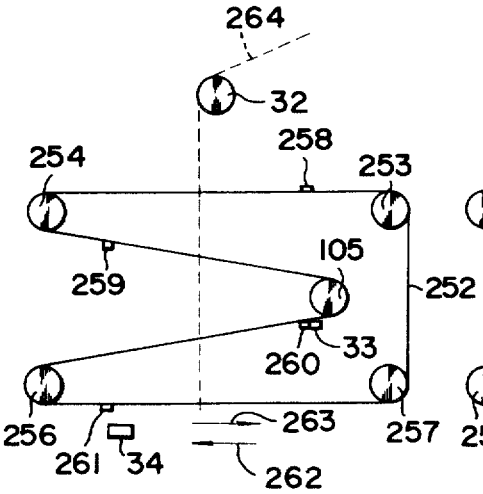
FIGS. 21 and 22 are cross-sectional views thereof.
Figure 22:
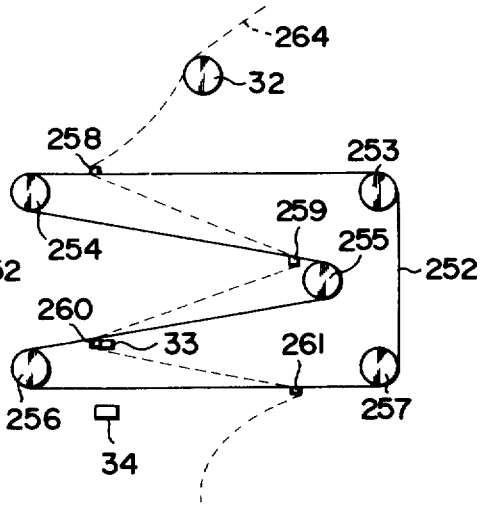

FIG. 21 and 22 are lateral views of the above-mentioned mechanism seen from the side of drive motor 251, respectively showing the states before and after the paper setting. In these drawings the drive motor 251 is omitted for the purpose of clarity, while a holding bar 32 is indicated. In the state before the paper setting, said movable bars 258, 259, 260 and 261 are positioned as illustrated in FIG. 21, with the paper 264 being placed as shown therein. Namely the paper is set to the recording apparatus in the manner explained in connection with FIG. 1 after the leading end of unprinted paper 30 is placed with respect to said movable bars 258, 259, 260, 261 as shown in FIG. 21.

Then the drive motor 251 is set into rotation by an unrepresented means to drive the chain 252 in the direction of arrow 263. Together with the movement of said chain 252 the movable bars 258, 259, 260 and 261 are displaced, and, upon arrival thereof at the positions shown in FIG. 22 the function of drive motor 251 is terminated. In this state the paper 264 is set in a position shown in FIG. 22. The movable bar 260 is provided with a paper end detector consisting of a light source 33, and a corresponding light receptor 34 is so provided as to face said light source 33 mounted on the bar 260 when the movable bars are displaced to the positions shown in FIG. 22. It will be apparent that the distance along the paper from the tractor 35 to the paper end detector 33, 34 is to be equal to the aforementioned distance $l_3$.

Potential Measuring Mechanism

Figure 23:
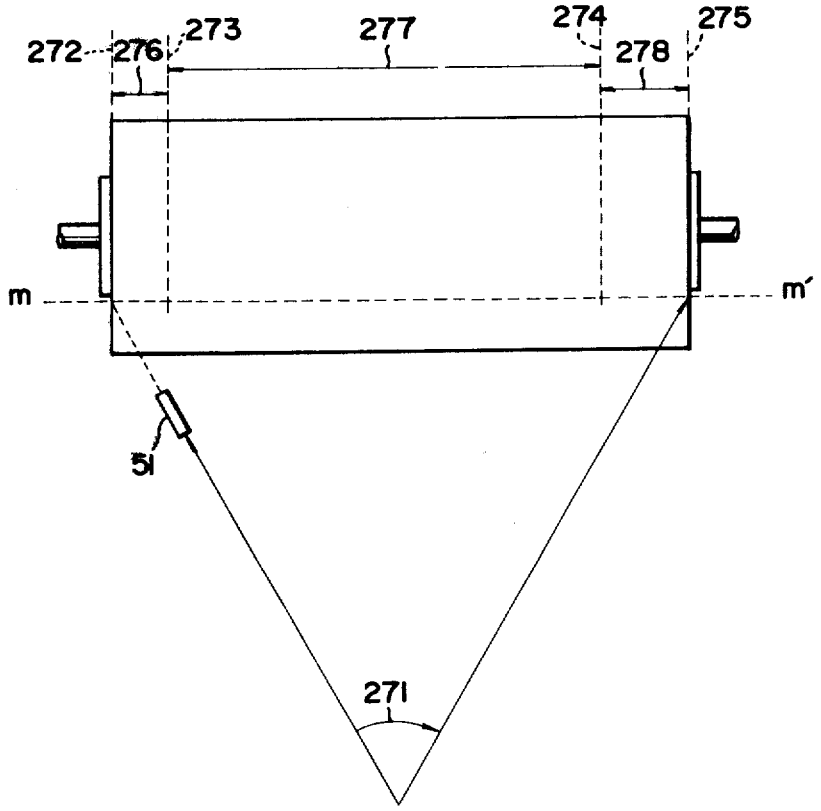
FIG. 23 is an elevation view of a photosensitive drum showing the position of a potential measuring head.

Now referring to FIG. 23 showing the positional relationship of scanning light beam with respect to the surface of photosensitive drum 14, m—m' is a scanning line of the light beam on the photosensitive drum; 271 is the scanning direction of laser beam; 272 is the position of beam detector 51 projected onto the photosensitive drum 14, namely the position where the laser beam coming out from the f−θ lens 13 and falling on the beam detector 51 will hit the photosensitive drum 14 in the absence of said beam detector; 273 is the print start position; 274 is the print end position; 275 is the drum end position in the scanning direction; 276 is the distance between the positions 272 and 273; and 278 is the distance between the positions 274 and 275 to be determined in connection with the dimension of potential measuring electrode and the distance thereof to the surface of photosensitive drum.

In case of making a potential measuring area outside the print area, such measuring area can be provided outside the print end position 274 shown in FIG. 23. However, such arrangement is undesirable for high-speed recording since the scanning will have to cover a widened range from the position 272 to the position 275, thus correspondingly increasing the deflecting angle of light beam.

On the other hand, the beam detector 51 is provided in order to detect to the scan start position of laser beam 52 and to determined the start timing of the modulation control signals for providing desired light information to the photosensitive drum 14.

The data processing device requires, from the receipt of signal from said beam detector 51 to the output of serial modulation control signals from the first shift register 81 which receives parallel input signals from the first memory 71 through CG 77, a processing time $\tau 271$.

Also the light modulation system with an acousto-optical modulation element utilizing an acousto-optical effect causes a delay $\tau 272$ from the receipt of modulation control signals to the actual modulation of laser beam because of the transmission velocity of ultrasonic wave in the modulation element.

Consequently a distance corresponding to the time $\tau 271+\tau 272$ will be inevitable whether or not the measurement of surface potential is conducted, and the area 276 is required also for the adjustment of left margin. Thus the increase of beam scanning area resulting from the potential measurement can be avoided if said area 276 is utilized for said measurement. With the potential measuring area provided in this manner, the scanning area by the laser beam can be approximately limited from the position 272 to the position 274 in FIG. 23, and this arrangement is thus advantageous in that the dimension of photosensitive drum 14 can be reduced, that a smaller scanning angle required for the f−θ lens 13 allows to reduce the production cost thereof, and that the scanning speed of light beam can be increased.

What we claim is:

1. A transfer material transporting device, usable with a recording apparatus capable of automatically loading a continuous transfer material and including means for transferring an image formed on an image holding member onto the continuous transfer material, said device comprising:

means for transporting said continuous transfer material along a path therefor through said transferring means;

at least a set of members for opening and closing said path, said opening and closing members being adapted to open said path so as to form a space wide enough to accommodate said continuous transfer material, wherein said opening and closing members comprise a fixing roller for fixing the transferred image on said continuous transfer material;

a transfer material holding member for passing through the path between said opening and closing members in the open state thereof while supporting a portion of said continuous transfer material and then stopping at a predetermined position;

an endless rotary member adapted for performing a circulating motion while supporting said transfer material holding member; and means for controlling the timing of the opening and closing functions of said opening and closing members in relation to the function of said endless rotary member.

2. A recording apparatus according to the claim 1, wherein said opening-closing members comprising a fixing roller for fixing the transferred image on said continuous recording material.

3. A transfer material feeding device, usable with a recording apparatus including means for transferring an image formed on an image holding member onto a continuous transfer material at an image transfer position, said device comprising:

index means for setting a particular position of said continuous transfer material; and transporting means for transporting said continuous transfer material through a distance substantially equal to a distance, measured along the path of the transfer material, from said index means to said image transfer means after the particular position of said continuous transfer material is set at said index means.

4. A transfer material feeding device according to the claim 3, wherein said distance from said index means to said transfer position is a multiple of the pitch of the advancing perforations provided on said continuous transfer material.

5. A transfer material feeding device according to the claim 3, wherein said index means is provided with a tolerance smaller than the pitch of the advancing perforations provided on the continuous transfer material, and wherein the advancement of said continuous transfer material is performed under the control of a detecting means associated with the transporting means which engages said advancing perforations.

6. A transfer material feeding device according to claim 3, further comprising means for detecting the trailing end of said continuous transfer material, said means being provided upstream of said image transfer position in said path for the continuous transfer material and at a position separated from said image transfer position by a distance at least equal to the sum of the distance, measured along said path, from said image forming position to said image transfer position and a length of said continuous transfer material required for said image formation.

7. A transfer material feeding device according to the claim 6, further comprising a transfer material path prolonging means positioned between said image transfer position and a feeding station for transporting said continuous transfer material and composed of a pair of rollers and at least an additional roller provided between said pair of rollers, said pair of rollers and said additional roller being mutually movable so as to form a zigzag path therebetween for said continuous transfer material, and said end detecting means being provided between said prolonging means and said feeding station.

8. A transfer material feeding device, usable with a recording apparatus including means for transferring an image formed on an image holding member onto a continuous transfer material, said device comprising:

transport means for transporting said continuous transfer material;

transport position detecting means, drivingly connected to said transport means, for detecting a transport position of said transport means with respect to a reference position corresponding to a particular position of said continuous transfer material;

rotation phase detecting means, interrelated with a drive source, for detecting the phase of rotation; and means for drivingly connecting said transport position detecting means with said rotation phase detecting means.

9. A transfer material feeding device according to claim 8, wherein the start of transport of said continuous transfer material is controlled by said connecting means in relation to a signal from said rotation phase detecting means, and wherein termination of said transport is controlled by said connecting means in relation to a signal from said transport position detecting means.

10. A transfer material feeding device usable with a recording apparatus including means for transferring an image formed on an image holding member onto a continuous transfer material, said device comprising:

first transport means for transporting said continuous transfer material through a distance substantially equal to a distance, measured along the path of the transfer material, from an index to said image transfer means;

second transport means for transporting said continuous transfer material provided upstream of said transfer means;

a drive source for transmitting driving force to both of said transport means;

first link means provided in the drive force transmission path between said drive source and first transport means;

a second link means provided in the drive force transmission path between said drive source and second transport means; and means for controlling said first and second link means in such a manner that the start and termination of operation thereof occur at different times.

11. A transfer material feeding device according to the claim 10, wherein the drive induction time required to reach a predetermined transport speed from a stopped state of the continuous transfer material is selected shorter in the first transport means than in the second transport means, and wherein the start and termination of operation of said second link means precedes the start and termination of operation of said first link means.

12. A transfer material feeding device according to the claim 10, wherein said first transport means is a tractor and said second transport means is composed of a fixing roller and a back-up roller.

13. A transfer material transporting device, usable with a recording apparatus capable of automatically loading a continuous transfer material and including means for transferring an image formed on an image holding member onto the continuous transfer material, said device comprising:

means for transporting said continuous transfer material along a path therefore through said transferring means;

at least a set of members for opening and closing said path, said opening and closing members being adapted to open said path so as to form a space wide enough to accommodate said continuous transfer material, wherein said opening and closing members comprise fixing means, having a closable passage for the transfer material, for fixing the transferred image on said continuous transfer material;

a transfer holding member for passing through the path between said opening and closing members in the open state thereof while supporting a portion of said continuous transfer material and then stopping at a predetermined position; and an endless rotary member adapted for performing a circulating motion while supporting said transfer material holding member.

* * * * *